US008444779B2

(12) United States Patent
Era et al.

(10) Patent No.: US 8,444,779 B2
(45) Date of Patent: May 21, 2013

(54) CU—NI—SI—CO COPPER ALLOY FOR ELECTRONIC MATERIALS AND METHOD FOR MANUFACTURING SAME

(75) Inventors: Naohiko Era, Ibaraki (JP); Hiroshi Kuwagaki, Ibaraki (JP)

(73) Assignee: JX Nippon Mining & Metals Co., Ltd., Tokyo (JP)

( * ) Notice: Subject to any disclaimer, the term of this patent is extended or adjusted under 35 U.S.C. 154(b) by 450 days.

(21) Appl. No.: 12/312,990

(22) PCT Filed: Aug. 22, 2008

(86) PCT No.: PCT/JP2008/065020

§ 371 (c)(1),
(2), (4) Date: Jun. 3, 2009

(87) PCT Pub. No.: WO2009/041197

PCT Pub. Date: Apr. 2, 2009

(65) Prior Publication Data

US 2009/0301614 A1 Dec. 10, 2009

(30) Foreign Application Priority Data

Sep. 28, 2007 (JP) ..... 2007-254197

(51) Int. Cl.
*C22C 9/06* (2006.01)
*C22F 1/08* (2006.01)

(52) U.S. Cl.
USPC ..... 148/435; 148/432; 148/433; 148/434; 148/436; 148/554; 148/681; 148/682; 148/684; 148/685; 420/485

(58) Field of Classification Search
USPC ..... 148/432–436, 554, 681, 682, 684, 148/685; 420/485–488
See application file for complete search history.

(56) References Cited

U.S. PATENT DOCUMENTS

| | | | | |
|---|---|---|---|---|
| 2002/0127133 | A1 | 9/2002 | Usami et al. | 420/485 |
| 2003/0155050 | A1 | 8/2003 | Liu et al. | 148/554 |
| 2005/0263218 | A1 | 12/2005 | Tanaka et al. | 148/433 |
| 2006/0196586 | A1 | 9/2006 | Hasegawa et al. | 148/685 |
| 2009/0035174 | A1 * | 2/2009 | Era et al. | 420/473 |

FOREIGN PATENT DOCUMENTS

| | | |
|---|---|---|
| JP | 58-123846 | 7/1983 |
| JP | 62086151 | 4/1987 |
| JP | 63-143230 | 6/1988 |
| JP | 2213436 | 8/1990 |
| JP | 9020943 | 1/1997 |
| JP | 11-222641 | 8/1999 |
| JP | 2001-049369 | 2/2001 |
| JP | 2001049369 A * | 2/2001 |
| JP | 2006-233314 | 9/2006 |
| JP | 2006-283120 | 10/2006 |
| JP | 2006274422 | 10/2006 |
| JP | 2007-100145 | 4/2007 |
| JP | 2007-107062 | 4/2007 |
| JP | 2007-136467 | 6/2007 |
| JP | 2008-038231 | 2/2008 |
| JP | 2008-248333 | 10/2008 |
| WO | WO 2004/005560 | 1/2004 |
| WO | WO 2006/101172 | 9/2006 |
| WO | WO 2006/106939 | 10/2006 |

OTHER PUBLICATIONS

European Search Report of EP 08 83 3441.

* cited by examiner

*Primary Examiner* — Sikyin Ip
(74) *Attorney, Agent, or Firm* — Drinker Biddle & Reath LLP

(57) ABSTRACT

The invention provides Cu—Ni—Si—Co alloys having excellent strength, electrical conductivity, and press-punching properties. In one aspect, the invention is a copper alloy for electronic materials, containing 1.0 to 2.5 mass % of Ni, 0.5 to 2.5 mass % of Co, and 0.30 to 1.2 mass % of Si, the balance being Cu and unavoidable impurities, wherein the copper alloy for electronic material has a [Ni+Co+Si] content in which the median value ρ (mass %) satisfies the formula 20 (mass %)≦ρ≦60 (mass %), the standard deviation σ (Ni+Co+Si) satisfies the formula σ (Ni+Co+Si)≦30 (mass %), and the surface area ratio S (%) satisfies the formula 1%≦S≦10%, in relation to the compositional variation and the surface area ratio of second-phase particles size of 0.1 μm or greater and 1 μm or less when observed in a cross section parallel to a rolling direction.

7 Claims, No Drawings

CU—NI—SI—CO COPPER ALLOY FOR ELECTRONIC MATERIALS AND METHOD FOR MANUFACTURING SAME

FIELD OF THE INVENTION

The present invention relates to precipitation hardening copper alloys, in particular, to Cu—Ni—Si—Co copper alloys suitable for use in a variety of electronic components.

BACKGROUND OF THE INVENTION

A copper alloy for electronic materials that are used in a connector, switch, relay, pin, terminal, lead frame, and various other electronic components is required to satisfy both high strength and high electrical conductivity (or thermal conductivity) as basic characteristics. In recent years, as high integration and reduction in size and thickness of an electronic component have been rapidly advancing, requirements for copper alloys used in these electronic components have been increasingly becoming severe.

Because of considerations related to high strength and high electrical conductivity, the amount in which precipitation-hardened copper alloys are used has been increasing, replacing conventional solid-solution strengthened copper alloys typified by phosphor bronze and brass as copper alloys for electronic components. With a precipitation-hardened copper alloy, the aging of a solution-treated supersaturated solid solution causes fine precipitates to be uniformly dispersed and the strength of the alloys to increase. At the same time, the amount of solved elements in the copper is reduced and electrical conductivity is improved. For this reason, it is possible to obtain materials having excellent strength, spring property, and other mechanical characteristics, as well as high electrical and thermal conductivity.

Among precipitation hardening copper alloys, Cu—Ni—Si copper alloys commonly referred to as Corson alloys are typical copper alloys having relatively high electrical conductivity, strength, and bending workability, and are among the alloys that are currently being actively developed in the industry. In these copper alloys, fine particles of Ni—Si intermetallic compounds are precipitated in the copper matrix, thereby increasing strength and electrical conductivity.

Various technical developments have been made with the aim of further improving the characteristics of Corson alloys, including the addition of alloy elements other than Ni and Si, the removal of elements that negatively affect characteristics, the optimization of the crystal structure, and the optimization of precipitating particles.

For example, it is known that characteristics are improved by adding Co.

It is disclosed in Japanese Laid-open Patent Application 11-222641 (Patent Document 1) that Co is similar to Ni in forming a compound with Si and increasing mechanical strength, and when Cu—Co—Si alloys are aged, they have slightly better mechanical strength and electrical conductivity than Cu—Ni—Si alloys. The document also states that, where acceptable in cost, Cu—Co—Si and Cu—Ni—Co—Si alloys may be also selected.

Japanese Domestic Republication No. 2005-532477 (Patent Document 2) describes a tempered copper alloy comprising, in terms of weight, 1% to 2.5% nickel, 0.5 to 2.0% cobalt, and 0.5% to 1.5% silicon, with the balance being copper and unavoidable impurities, and having a total nickel and cobalt content of 1.7% to 4.3% and an (Ni+Co)/Si ratio of 2:1 to 7:1. The tempered copper alloy has electrical conductivity that exceeds 40% IACS. Cobalt in combination with silicon is believed to form a silicide that is effective for age hardening in order to limit crystal grain growth and improve softening resistance. When the cobalt content is less than 0.5%, the precipitation of the cobalt-containing silicide as second-phase is insufficient. In addition, when a minimum cobalt content of 0.5% is combined with a minimum silicon content of 0.5%, the grain size of the alloy after solution treatment is maintained at 20 microns or less. It is described in the document that when the cobalt content exceeds 2.5%, excessive second-phase particles precipitate, formability is reduced, and the copper alloy is endowed with undesirable ferromagnetic properties.

International Publication Pamphlet WO2006/101172 (Patent Document 3) discloses a dramatic improvement in the strength of a Co-containing Cu—Ni—Si alloy under certain compositional conditions. Specifically, a copper alloy for an electronic material is described in which the composition is about 0.5 to about 2.5 mass % of Ni, about 0.5 to about 2.5 mass % of Co, and about 0.30 to about 1.2 mass % of Si, with the balance being Cu and unavoidable impurities, the ratio of the total mass of Ni and Co to the mass of Si ([Ni+Co]/Si ratio) in the alloy composition satisfies the formula: about $4 \leqq [Ni+Co]/Si \leqq$ about 5, and the mass concentration ratio of Ni and Co (Ni/Co ratio) in the alloy composition satisfies the formula $0.5 \leqq Ni/Co \leqq$ about 2.

It is also disclosed that in solution treatment, it is effective to set the cooling rate to about 10° C. or greater per second because the strength-enhancing effect of the Cu—Ni—Si copper alloy is further demonstrated when the cooling rate after heating is intentionally increased.

It is also known that coarse inclusions in the copper matrix are preferably controlled.

Japanese Laid-open Patent Application 2001-49369 (Patent Document 4) discloses that a material capable of being used as a copper alloy for an electronic material can be provided by adjusting the components of a Cu—Ni—Si alloy; adding as required Mg, Zn, Sn, Fe, Ti, Zr, Cr, Al, P, Mn, Ag, and Be; and controlling and selecting manufacturing conditions to control the distribution of precipitates, crystallites, oxides, and other inclusions in the matrix. Specifically described is a copper alloy for an electronic material that has excellent strength and electrical conductivity, the alloy being characterized in that there are contained 1.0 to 4.8 wt % of Ni and 0.2 to 1.4 wt % of Si, with the balance being Cu and unavoidable impurities; the size of the inclusions is 10 μm or less; and the number of inclusions having a size of 5 to 10 μm is less than 50 per square millimeter in a cross-section parallel to the rolling direction.

Since coarse crystallites and precipitates of an Ni—Si alloy are sometimes formed in the solidification process during casting in semi-continuous casting, the document furthermore describes a method for controlling such a phenomenon. It is stated that "coarse inclusions are solved in the matrix by being heated for 1 hour or more at a temperature of 800° C. or higher, hot-rolled, and then brought to an end temperature of 650° C. or higher. However, the heating temperature is preferably kept at 800° C. or higher and less than 900° C. because problems are presented in that thick scales are formed and cracking occurs during hot rolling when the heating temperature is 900° C. or higher."

[Patent Document 1] Japanese Laid-open Patent Application 11-222641

[Patent Document 2] Japanese Domestic Republication No. 2005-532477

[Patent Document 3] International Publication Pamphlet WO2006/101172

[Patent Document 4] Japanese Laid-open Patent Application 2001-49369

Problems to be Solved by the Invention

It is thus known that strength and electrical conductivity can be improved by adding Co to a Cu—Ni—Si alloy, and the present inventors discovered through observation of a Cu—Ni—Si alloy structure to which Co has been added that a larger number of coarse second-phase particles is present than when Co is not added. The second-phase particles are mainly composed of silicides of Co (silicides of cobalt). Coarse second-phase particles do not contribute to strength, but in fact negatively affect bending workability.

The formation of coarse second-phase particles cannot be suppressed even when manufacturing is conducted under suppressible conditions for a Cu—Ni—Si alloy that does not contain Co. In other words, in a Cu—Ni—Si—Co alloy, the coarse second-phase particles primarily composed of Co silicide cannot be adequately formed into a solid solution in the matrix even by a method, such as that described in Patent Document 4, for suppressing the formation of coarse inclusions wherein the alloy is hot rolled after being kept at a temperature of 800° C. to 900° C. for one hour or more, and the end temperature is set to 650° C. or higher. Furthermore, coarse particles are not sufficiently suppressed even when a method such as that taught in Patent Document 3 is used for increasing the cooling rate following heating in solution treatment.

Based on the background described above, the inventor describes in an earlier undisclosed Japanese Patent Application 2007-92269 a Cu—Ni—Si—Co alloy in which the formation of coarse second-phase particles is suppressed. Specifically, a copper alloy for electronic materials is described as containing 1.0 to 2.5 mass % of Ni, 0.5 to 2.5 mass % of Co, and 0.30 to 1.20 mass % of Si, the balance being Cu and unavoidable impurities, wherein the copper alloy for electronic material is one which second-phase particles whose size is greater than 10 μm are not present, and in which second-phase particles size of 5 to 10 μm are present in an amount of 50 per square millimeter or less in a cross section parallel to the rolling direction.

In the process for manufacturing a Cu—Ni—Si—Co alloy in order to obtain the copper alloy described above, it is critical that the following two criteria be satisfied: (1) that the alloy be hot rolled after being kept for 1 hour or more at 950° C. to 1050° C., the temperature at the end of hot rolling be set to 850° C. or higher, and cooling be carried out at 15° C./s or greater; and (2) solution treatment be carried out at 850° C. to 1050° C. and cooling be carried out at 15° C./s or greater.

On the other hand, the copper alloy matrix is preferably a material having little metal mold abrasion during press cutting. The copper alloy according to the present invention features advantageous alloy characteristics in that strength is improved without sacrificing electrical conductivity or bending workability, but there is still room for improvement in terms of press-punching properties.

In view of the above, it is an object of the present invention to provide a Cu—Ni—Si—Co alloy that has excellent strength, electrical conductivity, and press-punching properties. Another object of the present invention is to provide a method for manufacturing such a Cu—Ni—Si—Co alloy.

Means for Solving the Problem

Metal mold abrasion is generally interpreted in the following manner on the basis of phenomena that occur in shearing. First, in shearing, cracks appear from the vicinity of the tip of the blade of either the punch or the die (and rarely from the tip of both blades simultaneously) when shear deformation (plastic deformation) proceeds to a certain extent in association with the bite of the punch. Next, the generated cracks grow as the machining progresses, new cracks are generated and link up to another crack that has been growing, and a fracture surface is produced. In this case, a burr is formed because the crack was generated from a position slightly offset from the tool blade tip along the side surface of the tool. The service life of the metal mold may be further reduced in the case that the burr abrades the side surface of the tool, and the burr portion is dislodged from the matrix and is left as metal powder in the interior of the metal mold.

It is therefore important to perform structural control that facilitates the initiation and propagation of cracks while reducing the plastic deformation (ductility) of the material in order to reduce burring. Until now, many studies have been carried out in relation to the distribution of second-phase particles and the ductility of the material, and it is known that ductility is reduced with an increase in second-phase particles and that metal mold abrasion can be reduced (Japanese Patent Nos. 3735005, 3797736, and 3800279). For example, in Japanese Laid-open Patent Application 10-219374, an example is shown in which press-punching processability can be improved by controlling the number of coarse second-phase particles having a size of 0.1 μm to 100 μm, preferably up to 10 μm. However, when such coarse particles are dispersed and the press-punching processability is improved, Ni, Si, and other strength-enhancing elements that were originally intended to be age precipitated are incorporated into the coarse particles in a preceding heat treatment step, the addition of strength-enhancing elements loses meaning, and it is difficult to obtain sufficient strength. Also, no mention is made of adding Co as in the present invention, neither is there any mention of the effect of adding Ni, Co, and Si together, nor of the behavior when these elements are contained in the second-phase particles. Burrs increase in size because ductility is increased with reduced material strength even in the case that the surface area ratio of the second-phase particles has increased.

The present inventors conducted thoroughgoing research in view of problems such as those described above in order to solve the present issues, and discovered that the present issues can be solved by controlling the composition and distribution state of second-phase particles in a Cu—Ni—Si—Co alloy that are smaller than second-phase particles having a size stipulated in Japanese Patent Application 2007-92269. Specifically, the median value ρ and the standard deviation (σ (Ni+Co+Si)) of the total content of Ni, Co, and Si, as well as the surface area ratio S occupied by the second-phase particles in the matrix are important factors in relation to second-phase particles size of 0.1 μm or greater and 1 μm or less. It was learned that by adequately controlling the above factors, press processability is improved without compromising the age precipitation hardening of the added Ni, Co, and Si elements.

The cooling rate of the material during the final solution treatment is important in order to bring the second-phase particles to a distribution state such as that described above. Specifically, the final solution treatment of the Cu—Ni—Si—Co alloy is carried out at 850° C. to 1050° C., and the alloy is treated in the following cooling step so that the cooling rate is set to no less than 1° C./s and less than 15° C./s while the temperature of the material is reduced from the solution treatment temperature to 650° C., and the average cooling rate is set to 15° C./s or greater when the alloy is cooled from 650° C. to 400° C.

The present invention was perfected in view of the findings described above.

According to one aspect, there is provided a copper alloy for electronic materials, containing 1.0 to 2.5 mass % of Ni, 0.5 to 2.5 mass % of Co, and 0.30 to 1.2 mass % of Si, the balance being Cu and unavoidable impurities, wherein the copper alloy satisfies the following conditions in relation to the compositional variation and the surface area ratio of second-phase particles size of 0.1 μm or greater and 1 μm or less when observed in a cross section parallel to a rolling direction:

the median value ρ (mass %) of a [Ni+Co+Si] content satisfies the formula 20 (mass %)≦ρ≦60 (mass %), the standard deviation σ (Ni+Co+Si) satisfies the formula σ (Ni+Co+Si)≦30 (mass %), and the surface area ratio S (%) satisfies the formula 1%≦S≦10%.

In one embodiment, the copper alloy for electronic materials of the present invention is one in which second-phase particles whose size is greater than 10 μm are not present, and second-phase particles size of 5 to 10 μm are present in an amount of 50 per square millimeter or less in a cross section parallel to the rolling direction.

In another embodiment, the copper alloy for electronic materials according to the present invention is one which Cr is furthermore contained in a maximum amount of 0.5 mass %.

In another embodiment, the copper alloy for electronic materials of the present invention is one in which a single element or two or more elements selected from Mg, Mn, Ag, and P are furthermore contained in total in a maximum amount of 0.5 mass %.

In another embodiment, the copper alloy for electronic materials of the present invention is one in which one or two elements selected from Sn and Zn are furthermore contained in total in a maximum amount of 2.0 mass %.

In another embodiment, the copper alloy for electronic materials of the present invention is one in which a single element or two or more elements selected from As, Sb, Be, B, Ti, Zr, Al, and Fe are furthermore contained in total in a maximum amount of 2.0 mass %.

According to another aspect, the present invention provides a method for manufacturing the above-described copper alloy, comprising sequentially performing:

step 1 for melt casting an ingot having a desired composition;

step 2 for heating the ingot for 1 hour or more at 950° C. to 1050° C., thereafter hot rolling the ingot, setting the temperature to 850° C. or higher when hot rolling is completed, and cooling the ingot at an average cooling rate of 15° C./s or greater from 850° C. to 400° C.;

step 3 for cold rolling;

step 4 for carrying out a solution treatment at 850° C. to 1050° C., cooling the material at a cooling rate of 1° C./s or greater and less than 15° C./s until the temperature of the material is reduced to 650° C., and cooling the material at an average cooling rate of 15° C./s or greater when the temperature is reduced from 650° C. to 400° C.;

step 5 for performing optional cold rolling;

step 6 for performing aging; and step 7 for performing optional cold rolling.

In another embodiment, the method for manufacturing a copper alloy according to the present invention in one in which step 2' is carried out instead of step 2, wherein hot-rolling is carried out after 1 hour or more of heating at 950° C. to 1050° C., the temperature at the end of hot rolling is set to 650° C. or higher, the average cooling rate is set to no more than 1° C./s and less than 15° C./s when the temperature of the material during hot rolling or subsequent cooling is reduced from 850° C. to 650° C., and the average cooling rate is set to 15° C./s or greater when the temperature is reduced from 650° C. to 400° C.

In yet another aspect, the present invention provides a wrought copper alloy product using the above-described copper alloy.

In yet another aspect, the present invention provides an electronic component using the above-described wrought copper alloy product.

EFFECT OF THE INVENTION

In accordance with the present invention, a Cu—Ni—Si—Co alloy having excellent press-punching properties in addition to excellent strength and electrical conductivity can be obtained because the distribution state of second-phase particles having a particular sized is controlled.

PREFERRED EMBODIMENTS OF THE INVENTION

Addition Amount of Ni, Co and Si

Ni, Co and Si form an intermetallic compound with appropriate heat-treatment, and make it possible to increase strength without adversely affecting electrical conductivity.

When the addition amounts of Ni, Co, and Si are such that Ni is less than 1.0 mass %, Co is less than 0.5 mass %, and Si is less than 0.3 mass %, respectively, the desired strength cannot be achieved, and conversely, when the additions amounts are such that Ni is greater than 2.5 mass %, Co is greater than 2.5 mass %, and Si is greater than 1.2 mass %, respectively, higher strength can be achieved, but electrical conductivity is dramatically reduced and hot workability is furthermore impaired. Therefore, the addition amounts of Ni, Co, and Si are such that Ni is 1.0 to 2.5 mass %, Co is 0.5 to 2.5 mass %, and Si is 0.30 to 1.2 mass %. The addition amounts of Ni, Co, and Si are preferably such that Ni is 1.5 to 2.0 mass %, Co is 0.5 to 2.0 mass %, and Si is 0.5 to 1.0 mass %.

Addition Amount of Cr

Cr preferentially precipitates along crystal grain boundaries in the cooling process at the time of casting. Therefore, the grain boundaries can be strengthened, cracking during hot rolling is less liable to occur, and a reduction in yield can be limited. In other words, Cr that has precipitated along the grain boundaries during casting is solved by solution treatment or the like, resulting in a compound with Si or precipitated particles having a bcc structure primarily composed of Cr in the subsequent aging precipitation. With an ordinary Cu—Ni—Si alloy, the portion of the added Si solved in the matrix, which has not contributed to aging precipitation, suppresses an increase in electrical conductivity, but the Si content solved in the matrix can be reduced and electrical conductivity can be increased without compromising strength by adding Cr as a silicide-forming element and causing silicide to further precipitate. However, when the Cr concentration exceeds 0.5 mass %, coarse second-phase particles are more easily formed and product characteristics are compromised. Therefore, in the Cu—Ni—Si—Co alloy according to the present invention, a maximum of 0.5 mass % of Cr can be added. However, since the effect of the addition is low at less than 0.03 mass %, it is preferred that the addition amount be 0.03 to 0.5 mass %, and more preferably 0.09 to 0.3 mass %.

Addition Amount of Mg, Mn, Ag, and P

The addition of traces of Mg, Mn, Ag, and P improves strength, stress relaxation characteristics, and other manufacturing characteristics without compromising electrical conductivity. The effect of the addition is primarily demonstrated by the formation of a solid solution in the matrix, but the effect can be further demonstrated when the elements are contained in the second-phase particles. However, when the total concentration of Mg, Mn, Ag, and P exceeds 0.5%, the effect of improving the characteristics becomes saturated and production is compromised. Therefore, in the Cu—Ni—Si—Co alloy according to the present invention, a single element or two or more elements selected from Mg, Mn, Ag, and P can be added in total in a maximum amount of 0.5 mass %. However, since the effect of the addition is low at less than 0.01 mass %, it is preferred that the addition amount be a total of 0.01 to 0.5 mass %, and more preferably a total of 0.04 to 0.2 mass %.

Addition Amount of Sn and Zn

The addition of traces of Sn and Zn also improves the strength, stress relaxation characteristics, plating properties, and other product characteristics without compromising electrical conductivity. The effect of the addition is primarily demonstrated by the formation of a solid solution in the matrix. However, when the total amount of Sn and Zn exceeds 2.0 mass %, the characteristics improvement effect becomes saturated and manufacturability is compromised. Therefore, in the Cu—Ni—Si—Co alloy according to the present invention, one or two elements selected from Sn and Zn can be added in total in a maximum amount of 2.0 mass %. However, since the effect of the addition is low at less than 0.05 mass %, it is preferred that the addition amount be a total of 0.05 to 2.0 mass %, and more preferably a total of 0.5 to 1.0 mass %.

Addition Amount of As, Sb, Be, B, Ti, Zr, Al, and Fe

Electrical conductivity, strength, stress relaxation characteristics, plating properties, and other product characteristics are improved by adjusting the addition amount of As, Sb, Be, B, Ti, Zr, Al, and Fe in accordance with the required product characteristics. The effect of the addition is primarily demonstrated by the formation of a solid solution in the matrix, but a further effect can be demonstrated when the above-described elements are added to the second-phase particles or when second-phase particles having a new composition are formed. However, when the total concentration of these elements exceeds 2.0%, the characteristics improvement effect becomes saturated and manufacturability is compromised. Therefore, in the Cu—Ni—Si—Co alloy according to the present invention, a single element or one or greater elements selected from As, Sb, Be, B, Ti, Zr, Al, and Fe can be added in total in a maximum amount of 2.0 mass %. However, since the effect of the addition is low at less than 0.001 mass %, it is preferred that the addition amount be a total of 0.001 to 2.0 mass %, and more preferably a total of 0.05 to 1.0 mass %.

Manufacturability is readily compromised when the addition amount of the Mg, Mn, Ag, P, Sn, Zn, As, Sb, Be, B, Ti, Zr, Al, and Fe described above exceeds 3.0 mass % as a total. Therefore, it is preferred that the total be 2.0 mass % or less, and more preferably 1.5 mass % or less.

Distribution Conditions of Second-Phase Particles

With Corson alloys, second-phase microparticles on the order of nanometers (generally 0.1 μm or less) primarily composed of intermetallic compounds are precipitated by a suitable aging treatment, and higher strength can be assured without reducing electrical conductivity. However, the Cu—Ni—Co—Si alloy of the present invention is different from a conventional Cu—Ni—Si Corson alloy, and coarse second-phase particles are readily generated during hot rolling, solution treatment, and other heat treatments because Co is aggressively added as an essential element for age precipitation hardening. Ni, Co, and Si are incorporated more easily into the particles as the particles become coarser. As a result, the amount of age precipitation hardening is reduced and higher strength cannot be assured because the amount of Ni, Co, and Si as a solid solution in the matrix is reduced.

In other words, it is preferred that the distribution of coarse second-phase particles be controlled because the number of precipitation microparticles of 0.1 μm or less that contribute to precipitation hardening decreases with increased size and number of second-phase particles containing Ni, Co, and Si.

In the present invention, the phrase "second-phase particles" primarily refers to silicides, but no limitation is imposed thereby, and the phrase may also refer to crystallites generated in the solidification process of casting and precipitates generated in the cooling process, as well as precipitates generated in the cooling process that follows hot rolling, precipitates generated in the cooling process that follows solution treatment, and precipitates generated in aging treatment.

Coarse second-phase particles whose size exceeds 1 μm not only make no contribution to strength, but also reduce bending workability, regardless of the composition of the particles. The upper limit must be set to 10 μm because second-phase particles in particular whose size exceeds 10 μm dramatically reduce bending workability and do not produce any discernible improvement in the punching properties. Therefore, in a preferred embodiment of the present invention, second-phase particles whose size exceeds 10 μm are not present.

When the number of second-phase particles size of 5 μm to 10 μm is within 50 per square millimeter, strength, bending workability, and press-punching properties are not considerably compromised. Therefore, in another preferred embodiment of the present invention, the number of second-phase particles size of 5 μm to 10 μm is 50 per square millimeter or less, more preferably 25 per square millimeter or less, even more preferably 20 per square millimeter or less, and most preferably 15 per square millimeter or less, in a cross section parallel to the rolling direction.

Second-phase particles whose size exceeds 1 μm but is less than 5 μm are believed to have little effect on the degradation of characteristics in comparison with second-phase particles measuring 5 μm or greater because of the possibility that the increase in size of the crystal grains is suppressed to about 1 μm in the solution treatment stage, and the size increases in the subsequent aging treatment.

In addition to the findings described above, it was discovered in the present invention that the composition of second-phase particles size of 0.1 μm or greater and 1 μm or less has an affect on the press-punching properties when the particles are observed in a cross section parallel to the rolling direction, and considerable technological contribution is made in controlling this effect.

Median Value (ρ) of the [Ni+Co+Si] Content

First, press-punching properties improve when the Ni+Co+Si content of the second-phase particles size of 0.1

μm or greater and 1 μm or less is increased. It is when the median value ρ (mass %) of the [Ni+Co+Si] content of the second-phase particles is 20 (mass %) or higher that the improvement effect of the press-punching properties becomes significant. A p that is less than 20 mass % indicates a considerable presence of elements other than the Ni, Co, and Si contained in the second-phase particles, i.e., copper, oxygen, sulfur, and other unavoidable impurity elements, but such second-phase particles contribute little to the improvement of press-punching properties. An excessively high p indicates that Ni, Co, and Si added in anticipation of aging-induced precipitation hardening have been incorporated in excess into the second-phase particles size of 0.1 μm or greater and 1 μm or less, and precipitation hardening, which is the original function of these elements, becomes difficult to obtain. As a result, punching properties are degraded because strength is reduced and ductility is increased.

Therefore, in the present invention, second-phase particles whose size is 0.1 μm or greater and 1 μm or less, as measured when the material is observed in a cross section parallel to the rolling direction, are such that the median value ρ (mass %) of the [Ni+Co+Si] content satisfies the formula 20 (mass %)≦ρ≦60 (mass %), preferably 25 (mass %)≦ρ≦55 (mass %), and more preferably 30 (mass %)≦ρ≦50 (mass %).

Standard Deviation σ (Ni+Co+Si)

When there is considerable variation in the total Ni, Co, and Si content of the second-phase particles size of 0.1 μm or greater and 1 μm or less, the composition of the second-phase microparticles precipitated in the aging treatment also has considerable variations, and second-phase particles that do not have a composition of Ni, Co, and Si suitable for age hardening are present in disparate locations. In other words, the concentration of Ni, Co, and Si in the matrix is extremely low in the vicinity of the coarse second-phase particles having a high concentration of Ni, Co, and Si. Precipitation of second-phase microparticles is insufficient and strength is compromised when aging precipitation treatment is carried out in such a state. Strength is thereby locally reduced during press cutting, areas having high ductility are formed, and crack propagation is obstructed. As a result, strength sufficient for a copper alloy overall cannot be obtained, and press-punching properties are additionally degraded. Conversely, when there is little variation in the total Ni, Co, and Si content of the second-phase particles, the obstruction or local progress of crack propagation is suppressed, and a good fracture surface can be obtained. Therefore, the standard deviation cr (Ni+Co+Si) (mass %) of the [Ni+Co+Si] content of the second-phase particles is preferably kept as low as possible. When σ (Ni+Co+Si) is 30 or less, the there is only a slight adverse effect on characteristics.

In the present invention, the standard deviation σ (Ni+Co+Si) is stipulated to be ≦30 (mass %) when second-phase particles size of 0.1 μm or greater and 1 μm or less are observed in a cross section parallel to the rolling direction. The formula σ (Ni+Co+Si)≦25 (mass %) is preferably satisfied, and the formula σ (Ni+Co+Si)≦20 (mass %) is more preferably satisfied. The copper alloy for electronic material according to the present invention typically satisfies the formula 10≦σ (Ni+Co+Si)≦30, and more typically satisfies the formula 20≦σ (Ni+Co+Si)≦30, e.g., 20≦σ (Ni+Co+Si) ≦25.

Surface Area Ratio S

In addition, the surface area ratio S (%) of the second-phase particles size of 0.1 μm or greater and 1 μm or less in an observation field lying in a cross section parallel to the rolling direction affects the press-punching properties. The higher the surface area ratio of the second-phase particles is, the greater the improvement effect on the press-punching properties is. The surface area ratio is set to 1% or higher, and preferably 3% or higher. When the surface area ratio is less than 1%, the number of second-phase particles is low, the number of particles that contribute to crack propagation during press cutting is low, and the improvement effect on the press-punching properties is also low.

However, when the surface area ratio of the second-phase particles is excessively high, much of the Ni, Co, and Si added in anticipation of aging-induced precipitation hardening is incorporated into the coarse second-phase particles, and precipitation hardening, which is the original function of these elements, becomes difficult to obtain. As a result, punching properties are degraded because strength is reduced and ductility is increased. Therefore, in the present invention, the upper limit of the surface area ratio (%) occupied by second-phase particles size of 0.1 μm or greater and 1 μm or less in the observation field was kept at 10% when the second-phase particles were observed in a cross section parallel to the rolling direction. The surface area ratio is preferably 7% or less, and more preferably 5% or less.

In the present invention, the size of the second-phase particles refers to the diameter of the smallest circle that encompasses the second-phase particles when the particles are observed under the conditions described below.

The surface area ratio and compositional variation of the second-phase particles size of 0.1 μm or greater and 1 μm or less can be observed by jointly using FE-EPMA element mapping and image analysis software, and it is possible to measure the concentration of particles dispersed in the observation field, the number and size of the particles, and the surface area ratio of the second-phase particles in the observation field. The Ni, Co, and Si content of individual second-phase particles can be measured by EPMA quantitative analysis.

The size and number of second-phase particles whose size exceeds 1 μm can be measured by SEM observation, EPMA, or another electron microscope method after a cross section parallel to the rolling direction of the material has been etched. This is performed using the same method as that used for second-phase particles size of 0.1 to 1 μm as cited in claims of the present invention described below.

Manufacturing Method

With general manufacturing processes for Corson copper alloys, firstly electrolytic cathode copper, Ni, Si, Co, and other starting materials are melted in a melting furnace to obtain a molten metal having the desired composition. The molten metal is then cast into an ingot. Hot rolling is carried out thereafter, cold rolling and heat treatment are repeated, and a strip or a foil having a desired thickness and characteristics are finished. The heat treatment includes solution treatment and aging treatment. In the solution treatment, material is heated at a high temperature of about 700 to about 1000° C., the second-phase particles are solved in the Cu matrix, and the Cu matrix is simultaneously caused to re-crystallize. Hot rolling sometimes doubles as the solution treatment. In an aging treatment, material is heated for 1 hour or more in a temperature range of about 350 to about 550° C., and second-phase particles formed into a solid solution in the solution treatment are precipitated as microparticles on a nanometer order. The aging treatment results in increased strength and electrical conductivity. Cold rolling is sometimes performed before and/or after the aging treatment in order to obtain higher strength. Also, stress relief annealing (low-temperature annealing) is sometimes performed after cold rolling in the case that cold rolling is carried out after aging.

Grinding, polishing, shot blast, pickling, and the like may be carried out as needed in order to remove oxidized scale on the surface as needed between each of the above-described steps.

The manufacturing process described above is also used in the copper alloy according to the present invention, and it is important to strictly control hot rolling and solution treatment in order obtain the desired distribution configuration for second-phase particles size of 0.1 μm or greater and 1 μm or less, as well as the distribution configuration of coarse second-phase particles whose size exceeds 1 μm, in the copper alloy ultimately obtained. This is because the Cu—Ni—Co—Si alloy of the present invention is different from conventional Cu—Ni—Si-based Corson alloys in that Co (Cr as well, in some cases), which readily increases the size of the second-phase particles, is aggressively added as an essential component for age precipitation hardening. This is due to the fact that the generation and growth rate of the second-phase particles, which are formed by the added Co together with Ni and Si, are sensitive to the holding temperature and cooling rate during heat treatment.

First, coarse crystallites are unavoidably generated in the solidification process at the time of casting, and coarse precipitates are unavoidably generated in the cooling process. Therefore, the second-phase particles must form a solid solution in the matrix in the steps that follow. The material is held for 1 hour or more at 950° C. to 1050° C. and then subjected to hot rolling, and when the temperature at the end of hot rolling is set to 850° C. or higher, a solid solution can be formed in the matrix even when Co, and Cr as well, have been added. The temperature condition of 950° C. or higher is a higher temperature setting than in the case of other Corson alloys. When the holding temperature prior to hot rolling is less than 950° C., the solid solution in inadequate, and when the temperature is greater than 1050° C., it is possible that the material will melt. When the temperature at the end of hot rolling is less than 850° C., it is difficult to obtain high strength because the elements, which have formed a solid solution, will precipitate again. Therefore, it is preferred that hot rolling be ended at 850° C. and the material be rapidly cooled in order to obtain high strength.

Specifically, the cooling rate established when the temperature of the material is reduced from 850° C. to 400° C. following hot rolling is 15° C./s or greater, preferably 18° C./s or greater, e.g., 15 to 25° C./s, and typically 15 to 20° C./s.

The goal in the solution treatment is to cause crystallized particles during casting and precipitation particles following hot rolling to solve into a solid solution and to enhance age hardening capability in the solution treatment and thereafter. In this case, the holding temperature and time during solution treatment and the cooling rate after holding are important for controlling the composition and surface area ratio of the second-phase particles. In the case that the holding time is constant, crystallized particles during casting and precipitation particles following hot rolling can be solved into a solid solution when the holding temperature is high, and the surface area ratio can be reduced. The higher the cooling rate is, the more easily precipitation can be controlled during cooling. However, when the cooling rate is excessively high, second-phase particles that contribute to punching properties are insufficient. Conversely, when the cooling rate is excessively low, age hardening capability is reduced because the second-phase particles become large during cooling, and the surface area ratio and the Ni, Co, and Si content of the second-phase particles increase. Since the increase in size of the second-phase particles is localized, the Ni, Co, Si content of the particles is more prone to variation. Therefore, setting the cooling rate is particularly important for controlling the composition and the surface area ratio of the second-phase particles.

Following solution treatment, second-phase particles are generated and grown from 850 to 650° C., and the second-phase particles increase in size thereafter from 650° C. to 400° C. Therefore, in order to disperse the second-phase particles required for improvement in the punching properties without compromising age hardening capability, two-stage cooling may be adopted after solution treatment, in which the material is gradually cooled from 850 to 650° C. and then rapidly cooled from 650° C. to 400° C.

Specifically, following solution treatment at 850° C. to 1050° C., the average cooling rate is set to 1° C./s or greater and less than 15° C./s, preferably 5° C./s or greater and 12° C./s or less when the temperature of the material is reduced from the solution treatment temperature to 650° C. The average cooling rate during the temperature reduction from 650° C. to 400° C. is set to 15° C./s or greater, preferably 18° C./s or greater, e.g., 15 to 25° C./s, and typically 15 to 20° C./s, whereby second-phase particles effective for improving press-punching properties are allowed to precipitate.

When the rate of cooling to 650° C. is set to less than 1° C./s, the second-phase particles cannot be brought to a desired distribution state because the second-phase particles precipitate excessively and increase in size. On the other hand, when the cooling rate is set to 15° C./s or greater, the second-phase particles again cannot be brought into a desired distribution state because the second-phase particles do not precipitate or precipitate only in a trace amount.

On the other hand, in the 400° C. to 650° C. region, the cooling rate is preferably increased as much as possible, and the average cooling rate must be set to 15° C./s or greater. The purpose of this is to prevent the second-phase particles precipitated in the temperature region of 650° C. to 850° C. from becoming larger than is necessary. Since precipitation of second-phase particles is considerable to about 400° C., the cooling rate at less than 400° C. is not problematic.

To control the cooling rate after solution treatment, the cooling rate may be adjusted by providing a slow cooling zone and a cooling zone adjacent to the heating zone that has been heated to a range of 850° C. to 1050° C., and adjusting the corresponding holding times. In the case that rapid cooling is required, water-cooling can be used as the cooling method, and in the case that gradual cooling is used, a temperature gradient may be provided inside the furnace.

Two-stage cooling such as that described above is also effective for the cooling rate following hot rolling. Specifically, when the temperature of the material is reduced from 850° C. to 650° C., the average cooling rate is set to 1° C./s or greater and less than 15° C./s, preferably 3° C./s or greater and 12° C./s or less, and more preferably 5° C./s or greater and 10° C./s or less, regardless of whether in the midst of hot rolling or during subsequent cooling. When the temperature of the material is reduced from 650° C. to 400° C., the average cooling rate is set to 15° C./s or greater, preferably 17° C./s or greater. When the solution treatment is carried out in hot rolling after such a cooling process has been performed, a more desirable distribution state of the second-phase particles can be obtained. When such a cooling scheme is adopted, the temperature at the completion of hot rolling is not required to be set to 850° C. or higher, and there is no disadvantage even when the temperature at the completion of hot rolling is reduced to 650° C.

Coarse second-phase particles cannot be sufficiently suppressed in the subsequent aging treatment when the cooling rate after solution treatment is controlled alone without managing the cooling rate following hot rolling. The cooling rate after hot rolling and the cooling rate after solution treatment must both be controlled.

Water-cooling is the most effective method for increasing the cooling rate. However, the cooling rate can be increased by managing the water temperature because the cooling rate varies due to the temperature of the water to be used for water-cooling. The water temperature is preferably kept at 25° C. or lower because the desired cooling rate sometimes cannot be achieved when the water temperature is 25° C. or higher. When the material is placed in a tank filled with water, the temperature of the water readily increases to 25° C. or higher. Therefore, it is preferred that a spray (shower or mist) be used, cold water be constantly allowed to flow into the water tank, or the water temperature be otherwise prevented from increasing so that the material is cooled at a constant water temperature (25° C. or lower). The cooling rate can be increased by providing additional water-cooling nozzles or increasing the flow rate of water per unit of time.

In the present invention, the "average cooling rate from 850° C. to 400° C." after hot rolling refers to the value (° C./s) obtained by measuring the time when the temperature of the material is reduced from 850° C. to 400° C. and calculating the expression "(850–400) (° C.)/Cooling time (s)." The "average cooling rate until the temperature is reduced to 650° C." after solution treatment refers to the value (° C./s) obtained by measuring the cooling time in which the temperature is reduced to 650° C. from the temperature of the material maintained in the solution treatment, and calculating the expression "(Solution treatment temperature–650) (° C.)/Cooling time (s)." The "average cooling rate when the temperature is reduced from 650° C. to 400° C." similarly refers to the value (° C./s) obtained by calculating the expression "(650–400) (° C.)/Cooling time (s)." Furthermore, the average cooling rate "at the time the temperature is reduced from 850° C. to 650° C." refers to the value (° C./s) obtained by calculating the expression "(850–650) (° C.)/Cooling time (s)" in the same manner as when two-stage cooling is carried out after hot rolling as well, and the average cooling rate "at the time the temperature is reduced from 650° C. to 400° C." refers to the value (° C./s) obtained by calculating the expression "(650–400) (° C.)/cooling time (s)."

The conditions of the aging treatment may be those ordinarily used for effectively reducing the size of precipitates, but the temperature and time must be set so that the precipitates do not increase in size. An example of the age treatment conditions is a temperature range of 350 to 550° C. over 1 to 24 hours, and more preferably a temperature range of 400 to 500° C. over 1 to 24 hours. The cooling rate after aging treatment does not substantially affect the size of the precipitates.

The Cu—Ni—Si—Co alloy of the present invention can be used to manufacture various wrought copper alloy products, e.g., plates, strips, tubes, rods, and wires. The Cu—Ni—Si—Co alloy according to the present invention can be used in lead frames, connectors, pins, terminals, relays, switches, foil material for secondary batteries, and other electronic components or the like.

EXAMPLES

Examples of the present invention are described below together with comparative examples. The examples are provided for facilitating understanding of the present invention and the advantages thereof, and are not intended to limit the scope of the invention.

Study of the Effect of Manufacturing Conditions on Alloy Characteristics

A copper alloy having the composition (Composition No. 1) shown in Table 1 was melted in a high-frequency melting furnace at 1300° C. and then cast into an ingot having a thickness of 30 mm. Next, the ingot was heated to 1000° C., hot rolled thereafter to a plate thickness of 10 mm at a finishing temperature (the temperature at the completion of hot rolling) of 900° C., rapidly cooled to 400° C. at a cooling rate of 18° C./s after the completion of hot rolling, and then air cooling. Next, the metal was faced to a thickness of 9 mm in order to remove scales from the surface, and sheets having a thickness of 0.15 mm were then formed by cold rolling. Solution treatment was subsequently carried out for 120 seconds at various temperatures, and the sheets were immediately cooled to 400° C. at various cooling rates and then left in open air to cool. The sheets were then cold rolled to 0.10 mm, subjected to age treatment in an inert atmosphere for 3 hours at 450° C., and lastly cold rolled to 0.08 mm and ultimately annealed at low temperature for three hours at 300° C. to manufacture test pieces.

TABLE 1

| Composition | Ni | Co | Si | Cr |
|---|---|---|---|---|
| | 1.0 to 2.5 | 0.5 to 2.5 | 0.3 to 1.2 | to 0.5 |
| Φ | 1.8 | 1.0 | 0.65 | — |

Each test piece thus obtained was measured in the following manner to obtain the median value ρ (mass %), the standard deviation σ (Ni+Co+Si) (mass %), and the surface area ratio S (%) of the total Ni, Co, and Si content of the second-phase particles, as well as the size distribution of the second-phase particles, and the alloy characteristics.

First, the surface of the material was electropolished and the Cu matrix was dissolved, whereupon second-phase particles appeared from the dissolution. The electropolishing fluid that was used was a mixture of phosphoric acid, sulfuric acid, and purified water is a suitable ratio.

When the second-phase particles size of 0.1 to 1 μm were observed, an FE-EPMA (Electrolytic discharge-type EPMA: JXA-8500F manufactured by Japan Electron Optics Laboratory Co., Ltd.) was used for observing and analyzing all of the second-phase particles size of 0.1 and 1 μm dispersed in ten arbitrary locations at an observation magnification of ×3000 (observation field: 30 μm×30 μm) using an acceleration voltage of 5 to 10 kV, a sample current of $2\times10^{-8}$ to $10^{-10}$ A, and spectroscopic crystals LDE, TAP, PET, and LIF. Accessory image analysis software was used for calculating the median value ρ (mass %), the standard deviation σ (Ni+Co+Si) (mass %), and the surface area ratio S (%) of the total Ni, Co, and Si content of the particles.

On the other hand, when the second-phase particles whose size exceeds 1 μm were observed, the same method was used as in the observation of the second-phase particles size of 0.1 μm to 1 μm. A magnification of ×1000 (observation field: 100×120 μm) was used to observe ten arbitrary locations, the number of precipitates size of 5 to 10 μm and the number of precipitates whose size exceeds 10 μm were counted, and the number of precipitates per square millimeter was calculated.

Strength was tested using a tensile test carried out in the rolling direction, and 0.2% yield strength (YS: MPa) was measured.

The electrical conductivity (EC: % IACS) was determined by measuring volume resistivity with the aid of double bridge.

The punching properties were evaluated using burr height. The mold clearance was set to 10%, numerous angled holes (1 mm×5 mm) were punched using the mold at a punching rate of 250 spin, and the burr height (average value of ten locations) was measured by SEM observation. Punches having a burr height of 15 μm or less are indicated by ○ as acceptable, and punches having a burr height of greater than 15 μm are indicated by X as unacceptable.

The manufacturing conditions and results are shown in Table 2.

In comparative examples 1, 7, 8, 14, the average cooling rate maintained until the temperature was reduced to 650° C. was excessively high after solution treatment, and the surface area ratio and Ni, Co, and Si concentration of the second-phase particles were reduced. As a result, the press-punching properties were inadequate. Comparative example 8 corresponds to example 1 described in Japanese Patent Application No. 2007-092269.

On the other hand, in comparative examples 6, 13, 19, the average cooling rate maintained until the temperature was reduced to 650° C. was excessively low after solution treatment, and the surface area ratio and Ni, Co, and Si concentration of the second-phase particles were elevated. As a result, the press-punching properties were inadequate. The strength was also low in comparison with the examples, and this is believed to be due to the fact that the Ni, Co, and Si concentration was higher in the coarse second-phase par-

TABLE 2

| | Solution treatment conditions | | | Composition and surface area ratio of second-phase particles (0.1 to 1 μm) | | | Number of second-phase particles | | Characteristics | | |
|---|---|---|---|---|---|---|---|---|---|---|---|
| | Heating temperature (° C.) | Cooling rate (° C./s) to 650° C. | Cooling rate (° C./s) to 400° C. | Ni, Co, Si ρ (wt %) | Ni, Co, Si σ (wt %) | S (%) | Number/mm$^2$ (5 to 10 μm) | Number/mm$^2$ (greater than 10 μm) | Strength (MPa) | Electrical conductivity (% IACS) | Burr height (μm) |
| Target | 850 to 1050 | 1 < 15 | 15≦ | 20 ≦ 60 | ≦30 | 1 ≦ 10 | ≦50 | 0 | | | ≦15 |
| Comparative example 1 | 1000 | 18 | 18 | 11 | 13 | 0.7 | 5 | 0 | 885 | 47 | X |
| Example 1 | 1000 | 12 | 18 | 22 | 21 | 2.0 | 5 | 0 | 880 | 48 | ○ |
| Comparative example 2 | 1000 | 12 | 12 | 32 | 31 | 2.5 | 6 | 0 | 875 | 48 | X |
| Comparative example 3 | 1000 | 12 | 5 | 39 | 32 | 2.9 | 11 | 0 | 860 | 48 | X |
| Example 2 | 1000 | 5 | 18 | 36 | 20 | 3.3 | 9 | 0 | 870 | 49 | ○ |
| Comparative example 4 | 1000 | 5 | 12 | 47 | 31 | 4.1 | 10 | 0 | 865 | 49 | X |
| Comparative example 5 | 1000 | 5 | 5 | 65 | 32 | 6.5 | 17 | 0 | 850 | 49 | X |
| Comparative example 6 | 1000 | 0.5 | 18 | 70 | 36 | 10.1 | 52 | 0 | 790 | 52 | X |
| Comparative example 7 | 950 | 18 | 18 | 16 | 14 | 0.8 | 6 | 0 | 875 | 48 | X |
| Example 3 | 950 | 12 | 18 | 24 | 23 | 2.3 | 10 | 0 | 870 | 48 | ○ |
| Comparative example 9 | 950 | 12 | 12 | 35 | 31 | 2.4 | 11 | 0 | 865 | 48 | X |
| Comparative example 10 | 950 | 12 | 5 | 43 | 34 | 2.7 | 16 | 0 | 850 | 48 | X |
| Example 4 | 950 | 5 | 18 | 45 | 25 | 3.7 | 12 | 0 | 860 | 50 | ○ |
| Comparative example 11 | 950 | 5 | 12 | 54 | 32 | 4.3 | 15 | 0 | 855 | 50 | X |
| Comparative example 12 | 950 | 5 | 5 | 69 | 34 | 7.9 | 18 | 0 | 845 | 50 | X |
| Comparative example 13 | 950 | 0.5 | 18 | 75 | 39 | 13.2 | 55 | 0 | 770 | 53 | X |
| Comparative example 14 | 875 | 18 | 18 | 19 | 16 | 0.9 | 10 | 0 | 860 | 50 | X |
| Example 5 | 875 | 12 | 18 | 43 | 25 | 3.9 | 13 | 0 | 855 | 50 | ○ |
| Comparative example 15 | 875 | 12 | 12 | 32 | 32 | 5.2 | 17 | 0 | 850 | 50 | X |
| Comparative example 16 | 875 | 12 | 5 | 39 | 37 | 6.1 | 21 | 0 | 835 | 50 | X |
| Example 6 | 875 | 5 | 18 | 48 | 28 | 7.1 | 19 | 0 | 845 | 51 | ○ |
| Comparative example 17 | 875 | 5 | 12 | 53 | 32 | 9.1 | 20 | 0 | 840 | 51 | X |
| Comparative example 18 | 875 | 5 | 5 | 66 | 37 | 16.9 | 21 | 0 | 830 | 51 | X |
| Comparative example 19 | 875 | 0.5 | 13 | 77 | 42 | 2.42 | 59 | 0 | 750 | 53 | X |
| Comparative example 20 | 825 | 12 | 18 | 52 | 33 | 11.5 | 63 | 1 | 725 | 54 | X |
| Comparative example 21 | 825 | 5 | 18 | 77 | 43 | 22.4 | 122 | 9 | 690 | 56 | X |

The alloys of examples 1 to 6 were within a suitable range in terms of σ, ρ, S, the number of precipitates size of 5 to 10 μm and the number of precipitates whose size exceeds 10 μm. In addition to having excellent strength and electrical conductivity, the alloys had excellent characteristics in terms of press-punching properties.

ticles, as a result of which the particles did not precipitate as microparticles during aging treatment.

In comparative examples 2, 3, 4, 5, 9, 10, 11, 12, 15, 16, 17, 18, and 19, the average cooling rate was low when the temperature was reduced from 650° C. to 400° C., and the variation in the Ni, Co, and Si concentration of the second-phase particles was higher. As a result, the press-punching properties were inadequate.

In comparative examples 20 and 21, the variation in the Ni, Co, Si concentration of the second-phase particles was considerable, and the surface area ratio was also elevated because the temperature of the solution treatment was excessively low. In comparative example 21 as well, the Ni, Co, and Si concentration was elevated. As a result, the press-punching properties were inadequate. The strength was reduced in comparison with the examples, but this is believed to be due to the fact that the coarse second-phase particles did not precipitate as microparticles during the aging treatment as a result of the higher Ni, Co, and Si concentration of the particles.

Study of the Effect of Composition on Alloy Characteristics

Copper alloys having the compositions shown in Table 3 were melted in a high-frequency melting furnace at 1300° C. and then cast into an ingot having a thickness of 30 mm. Next, the ingot was heated to 1000° C., hot rolled thereafter to a plate thickness of 10 mm at a finishing temperature (the temperature at the completion of hot rolling) of 900° C., rapidly cooled to 400° C. at a cooling rate of 18° C./s after the completion of hot rolling, and then left in open air to cool. Next, the metal was faced to a thickness of 9 mm in order to remove scales from the surface, and sheets having a thickness of 0.15 mm were then formed by cold rolling. Solution treatment was subsequently carried out for 120 seconds at 950° C., and the sheets were immediately cooled from 850° C. to 650° C. at an average cooling rate of 12° C./s, and from 650° C. to 400° C. at an average cooling rate of 18° C./s. The sheets were cooled to 400° C. at a cooling rate of 18° C./s, and then left in open air to cool. Next, the sheets were cold rolled to 0.10 mm, subjected to age treatment in an inert atmosphere for 3 hours at 450° C., and lastly cold rolled to 0.08 mm and ultimately annealed at low temperature for three hours at 300° C. to manufacture test pieces.

All of the alloys of examples 7 to 16 were within a suitable range in terms of σ, ρ, S, the number of precipitates size of 5 to 10 μm, and the number of precipitates whose size exceeds 10 μm, and therefore had excellent press-punching properties in addition to excellent strength and electrical conductivity. Example 8 was the same as Example 3. It is apparent that strength is further enhanced by adding Cr or another additional element.

What is claimed is:

1. A copper allot for electronic material, containing 1.0 to 2.5 mass % of Ni, 0.5 to 2.5 mass % of Co, and 0.30 to 1.2 mass % of Si, wherein one or more of the following conditions (a)-(d) are optionally satisfied:

(a) Cr is furthermore contained in a maximum amount of 0.5 mass %;

(b) a single element or two or more elements selected from Mg, Mn, Ag, and P are furthermore contained in total in a maximum amount of 0:5 mass %;

(c) one or two elements selected from Sn and Zn are furthermore contained in total in a maximum amount of 2.0 mass %; and (d) a single element or two or more elements selected from As, Sb, Be, B, Ti, Zr, Al, and Fe are furthermore contained in total in a maximum amount of 2.0, mass %, the balance being Cu and unavoidable impurities;

wherein the copper alloy satisfies the following conditions in relation to the compositional variation and the surface area ratio of second-phase particles size of 0.1 μm or greater and 1 μm or less when observed in ten arbitrary locations each having an observation field of 30 μm×30 μm in a cross section parallel to a rolling direction:

the median value ρ(mass %) of a [Ni+Co+Si] content satisfies the formula 20 (mass %)≦ρ≦54 (mass %) based on the mass of said second phase particles, the standard deviation σ(Ni+Co+Si) satisfies the formula 13≦σ(Ni+Co+Si)≦28 (mass %) based on the mass of said second phase particles, and:

the surface area ratio S (%) satisfies the formula 2.0%≦S≦7.1%.

2. The copper alloy for electronic materials of claim 1, wherein second-phase particles whose size is greater than 10

TABLE 3

| | | | | | | Composition and surface area ratio of second-phase particles (0.1 to 1 μm) | | | Number of second-phase particles | | Characteristics | | |
|---|---|---|---|---|---|---|---|---|---|---|---|---|---|
| Composition | Ni | Co | Si | Cr | Other | Ni, Co, Si ρ (wt %) | Ni, Co, Si σ (wt %) | S (%) | Number/ $mm^2$ (5 to 10 μm) | Number/ $mm^2$ (greater than 10 μm) | Strength (MPa) | Electro-conductivity (% IACS) | Burr height (μm) |
| | 1.0 to 2.5 | 0.5 to 2.5 | 0.3 to 1.2 | to 0.5 | Mg, Ag, Sn, Zn, P, B | 20 ≦ 60 | ≦30 | 1 ≦ 10 | ≦50 | 0 | | | ≦15 |
| Example 7 | 1.5 | 1.0 | 0.6 | | | 20 | 19 | 2.1 | 8 | 0 | 850 | 49 | ○ |
| Example 8 | 1.8 | 1.0 | 0.65 | | | 24 | 23 | 2.3 | 10 | 0 | 870 | 48 | ○ |
| Example 9 | 1.8 | 1.0 | 0.65 | 0.1 | | 48 | 13 | 5.4 | 35 | 0 | 880 | 49 | ○ |
| Example 10 | 1.8 | 1.0 | 0.65 | | 0.1 Mg | 26 | 25 | 2.6 | 11 | 0 | 885 | 47 | ○ |
| Example 11 | 1.8 | 1.0 | 0.65 | 0.1 | 0.1 Mg | 49 | 14 | 5.7 | 39 | 0 | 900 | 48 | ○ |
| Example 12 | 1.8 | 1.0 | 0.65 | | 0.1 Mg, 0.5 Sn, 0.5 Zn | 27 | 26 | 2.6 | 11 | 0 | 895 | 45 | ○ |
| Example 13 | 1.8 | 1.0 | 0.65 | | 0.1 Mg, 0.5 Sn, 0.5 Zn | 27 | 26 | 2.6 | 11 | 0 | 898 | 44 | ○ |
| Example 14 | 1.8 | 1.0 | 0.65 | | 0.1 Ag | 24 | 23 | 2.3 | 10 | 0 | 871 | 48 | ○ |
| Example 15 | 1.8 | 1.0 | 0.65 | | 0.03 P | 24 | 23 | 2.3 | 10 | 0 | 871 | 48 | ○ |
| Example 16 | 2.0 | 1.0 | 0.70 | 0.1 | | 54 | 15 | 5.6 | 37 | 0 | 890 | 49 | ○ |

μm are not present, and second-phase particles size of 5 to 10 μm are present in an amount of 50 per square millimeter or less in a cross section parallel to the rolling direction.

3. The copper alloy for electronic materials of claim 1 or 2, wherein Cr is furthermore contained in a maximum amount of 0.5 mass %.

4. The copper alloy for electronic materials of claim 1 or 2, wherein one or more of the following conditions (a)-(d) are satisfied;

(a) Cr is furthermore contained in a maximum amount of 0.5 mass %;

(b) a single element or two or more elements selected from Mg, Mn, Ag, and P are furthermore contained in total in a maximum amount of 0.5 mass %;

(c) one or two elements selected from Sn and Zn are furthermore contained in total in a maximum amount of 2.0 mass %; and (d) a single element or two or more element selected from As, Sb, Be, B, Ti, Zr, Al, and Fc are furthermore contained in total in a maximum amount of 2.0 mass %.

5. A method for manufacturing the copper alloy according to claim 1, comprising sequentially performing:

step 1: casting an ingot having a desired-composition;

step 2: heating the ingot for 1 hour or mere at 950° C. to 1050° C., thereafter hot rolling the ingot, setting the temperature to 850° C. or higher when hot rolling is completed, and cooling the ingot at an average cooling rate of 15° C./s or greater from 850° C. to 400° C.;

step 3: cold rolling;

step 4: carrying out a solution treatment at 850° C. to 1050° C., cooling the material at a cooling rate of 5° C./s or greater and less than 12° C./s until the temperature of the material is reduced to 650° C., and cooling the material at an average cooling rate of 15° C./s 18° C./s or greater when the temperature is reduced from 650° C. to 400° C.;

step 5: performing optional cold rolling;

step 6: performing aging; and step 7: performing optional cold rolling.

6. A copper alloy product comprising the copper alloy of claim 1.

7. An electronic component comprising the copper alloy of claim 1.

* * * * *

UNITED STATES PATENT AND TRADEMARK OFFICE

CERTIFICATE OF CORRECTION

PATENT NO. : 8,444,779 B2
APPLICATION NO. : 12/312990
DATED : May 21, 2013
INVENTOR(S) : Era et al.

It is certified that error appears in the above-identified patent and that said Letters Patent is hereby corrected as shown below:

In the Claims:

Column 18, line 10, “allot” should read “alloy”

Column 18, line 19, “0:5” should read “0.5”

Column 18, line 25, “2.0,” should read “2.0”

Column 19, line 18, “more element” should read “more elements”

Column 20, line 2, “mere” should read “more”

Column 20, line 12, delete “15° C./s”

Signed and Sealed this
Seventeenth Day of September, 2013

Teresa Stanek Rea

Teresa Stanek Rea
*Deputy Director of the United States Patent and Trademark Office*